US009890513B1

(12) United States Patent
Wu et al.

(10) Patent No.: US 9,890,513 B1
(45) Date of Patent: Feb. 13, 2018

(54) LOCATABLE SLAB ASSEMBLY

(71) Applicant: Long Time Win Technology Co., Ltd., Kaohsiung (TW)

(72) Inventors: Ping-Hsien Wu, Kaohsiung (TW); Cheng-Lung Chen, Kaohsiung (TW)

(73) Assignee: Long Time Win Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/680,895

(22) Filed: Aug. 18, 2017

(30) Foreign Application Priority Data

May 19, 2017 (TW) ..... 106116574 A

(51) Int. Cl.
*E02D 29/14* (2006.01)

(52) U.S. Cl.
CPC ..... *E02D 29/14* (2013.01); *E02D 29/1418* (2013.01)

(58) Field of Classification Search
CPC ..... E02D 29/14; E02D 29/1418
USPC ..... 404/25, 26
See application file for complete search history.

(56) References Cited

U.S. PATENT DOCUMENTS 4,902,165 A * 2/1990 Embree ..... B65D 55/14 404/25
4,925,336 A * 5/1990 Simmonds ..... E02D 29/12 264/31
5,030,030 A * 7/1991 Simmonds ..... E02D 29/12 404/25
5,431,510 A * 7/1995 Reinert, Sr. ..... B64F 1/20 404/26
6,393,771 B1 * 5/2002 Stetson ..... E02D 29/14 404/25
6,769,834 B1 * 8/2004 Stange ..... E02D 29/1409 404/25
7,862,729 B2 * 1/2011 Stetson ..... E01C 11/227 210/164

* cited by examiner

*Primary Examiner* — Gary S Hartmann
(74) *Attorney, Agent, or Firm* — MH2 Technology Law Group, LLP

(57) ABSTRACT

A locatable slab assembly for overlying a manhole cover located beneath a lowermost surface of a pavement. The locatable slab assembly includes a slab body, a tubular member, a protective plug, and an electronic marker. The slab body is deposed to permit a central line of the slab body in line with a center line of the manhole cover. The electronic marker is configured to permit a region of the pavement in alignment with the center line of the manhole cover to be located. The locatable slab assembly together with the pavement thereon can be lifted to permit access of the manhole cover.

7 Claims, 15 Drawing Sheets

LOCATABLE SLAB ASSEMBLY

CROSS-REFERENCE TO RELATED APPLICATION

This application claims priority from Taiwanese patent application no. 106116574, filed on May 19, 2017, the entire disclosure of which is hereby incorporated by reference.

FIELD

The disclosure relates to a locatable slab assembly, more particularly to a locatable slab assembly by which a manhole cover located beneath a pavement can be precisely located.

BACKGROUND

As shown in FIG. 1, a manhole 12 is closed by a manhole cover 11 on the ground surface. Sometimes, the ground surface will be further paved with asphalt. In this case, as the manhole cover 11 may not be flush with the road surface, either road bump or depression would be formed. Traffic accidents may thus occur.

To solve this problem, as shown in FIG. 2, a manhole opening 12A is arranged at a depth (about 25 cm to 30 cm) beneath the ground surface, and a pavement 13 is paved on the manhole cover 11. In this case, to access to the manhole 12, it is necessary to locate the manhole cover 11. Taiwanese patent no. 1398567 discloses a method for locating a manhole cover using a metal detector.

Taiwanese utility module patent no. M507942 discloses another method for locating a manhole cover. Two radio-frequency identification (RFID) tags are disposed diagonally opposite to each other on the manhole cover. A center of the manhole cover beneath the ground surface may be determined using the two RFID tags.

SUMMARY

An object of the disclosure is to provide a novel locatable slab assembly, by which a manhole cover located beneath a pavement can be precisely located.

According to the disclosure, a locatable slab assembly is used for overlying a manhole cover which is located beneath a lowermost surface of a pavement, and which defines a center line. The locatable slab assembly is liftable by a lifting device which has a gripped head and a connected end segment that is opposite to the gripped head and that has an outer threaded surface. The locatable slab assembly includes a slab body, a tubular member, a protective plug, and an electronic marker. The slab body is configured to fully overlie the manhole cover, and defines a central line in line with the center line. The slab body has an upward surface, a downward surface, a cavity, and a bore. The cavity extends downwardly from the upward surface along the central line to terminate at a cavity bottom. The bore extends downwardly from the cavity bottom along the central line. The tubular member is fitted in the bore, and has an inner threaded region which surrounds the central line, and which defines a lower chamber extending to be in spatial communication with the cavity along the central line. The inner threaded region is configured to be brought into threaded engagement with the outer threaded surface, so as to permit the locatable slab assembly to be lifted by the lifting device. The protective plug has an enlarged head and a plug body which is configured to be inserted into the cavity to permit the enlarged head to be disposed outwardly of the slab body. The plug body is formed with an upper chamber extending to be in spatial communication with the lower chamber along the central line. The electronic marker has an upper segment disposed in the upper chamber and a lower segment disposed in the lower chamber. The electronic marker is configured to permit a region of the pavement in alignment with the center line of the manhole cover to be located.

BRIEF DESCRIPTION OF THE DRAWINGS

Other features and advantages of the disclosure will become apparent in the following detailed description of the embodiment with reference to the accompanying drawings, in which.

DETAILED DESCRIPTION

Figure 1:
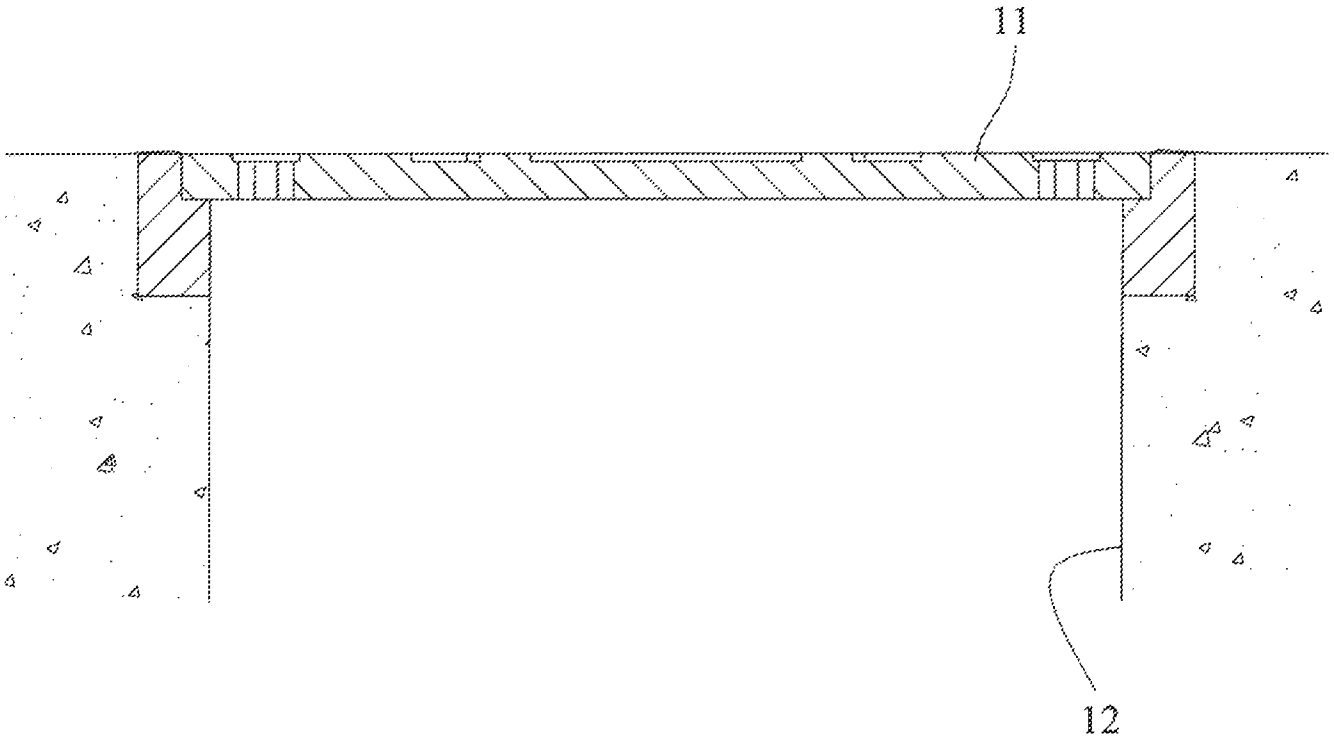
FIG.1 PRIOR ART
FIG. 1 is a schematic cross sectional view illustrating a manhole cover on the ground surface.
Figure 2:
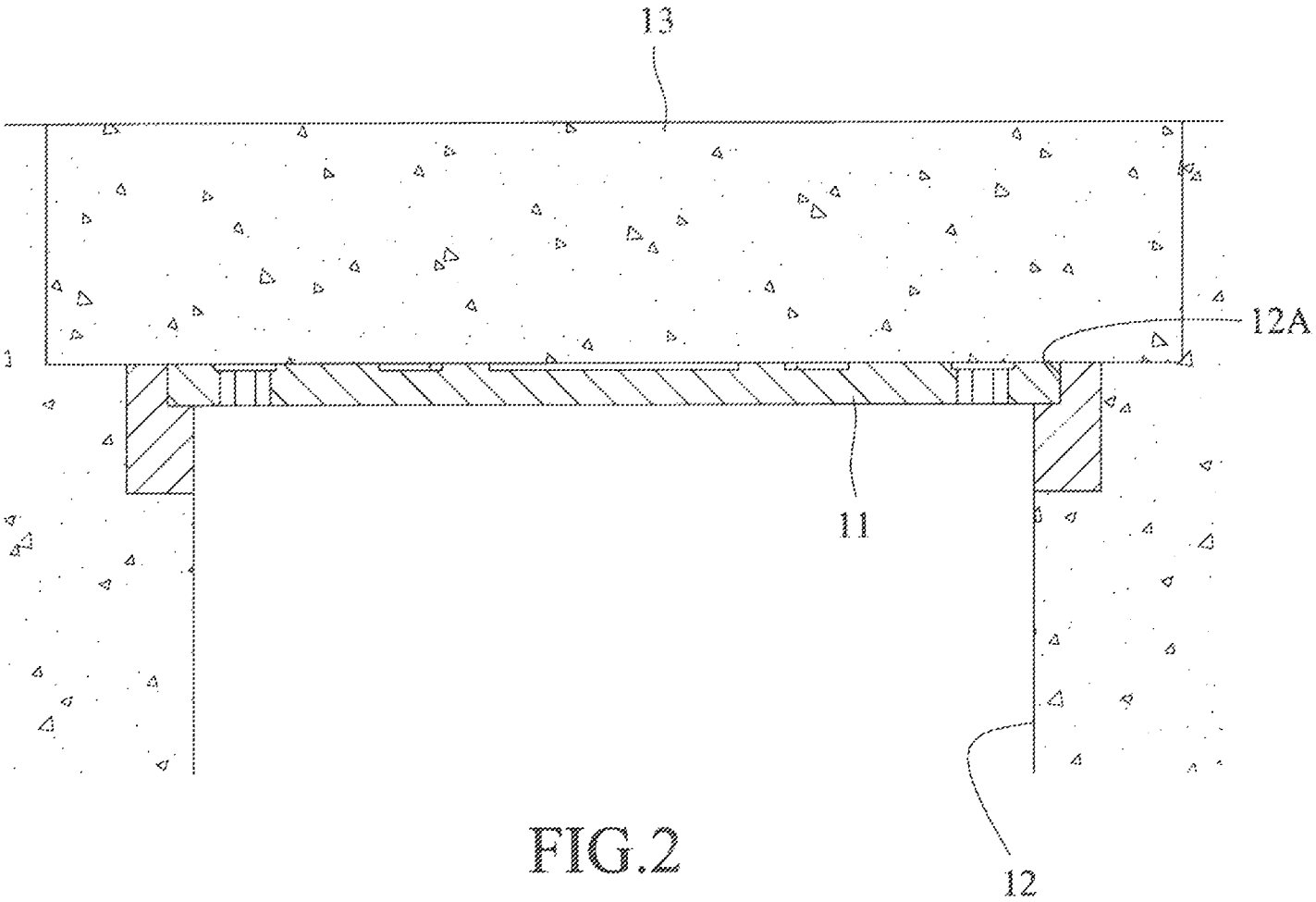
FIG.2 PRIOR ART
FIG. 2 is a schematic cross sectional view illustrating a manhole cover located beneath the ground surface.
Figure 3:
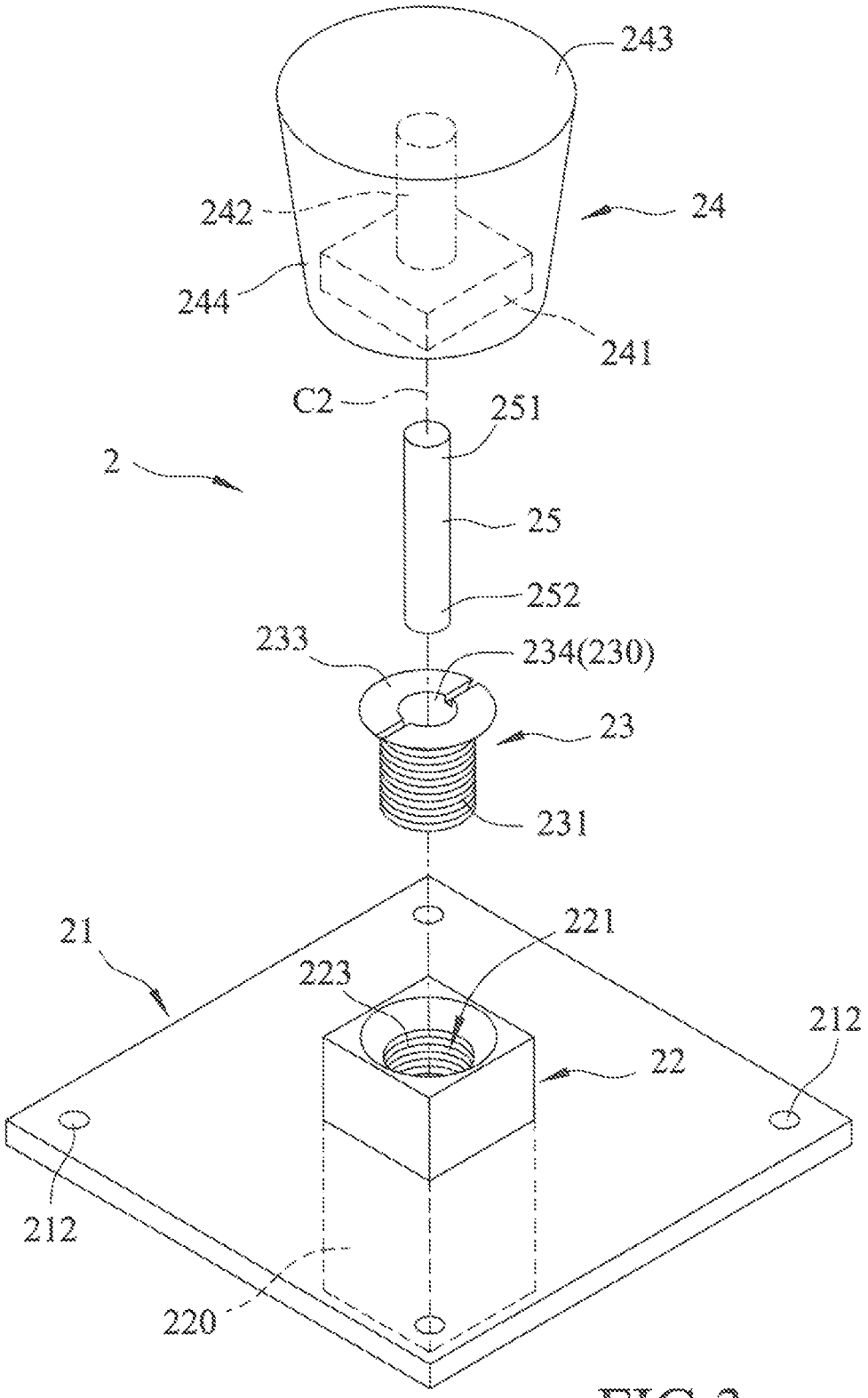
FIG. 3 is an exploded perspective view of a locatable slab assembly according to an embodiment of the disclosure, in which a slab body and binding wires are omitted.
Figure 4:
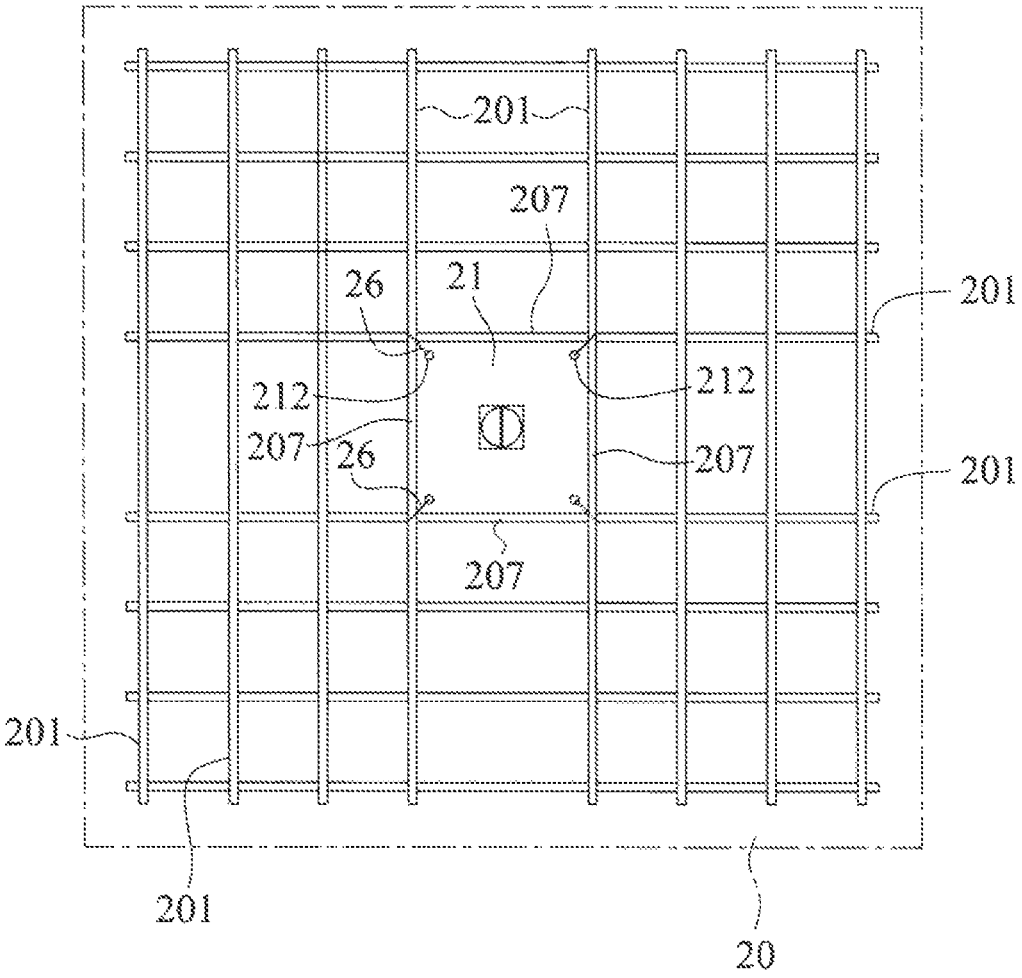
FIG. 4 is a top view illustrating steel bars in a slab body of the locatable slab assembly in which a protective plug is omitted.
Figure 5:
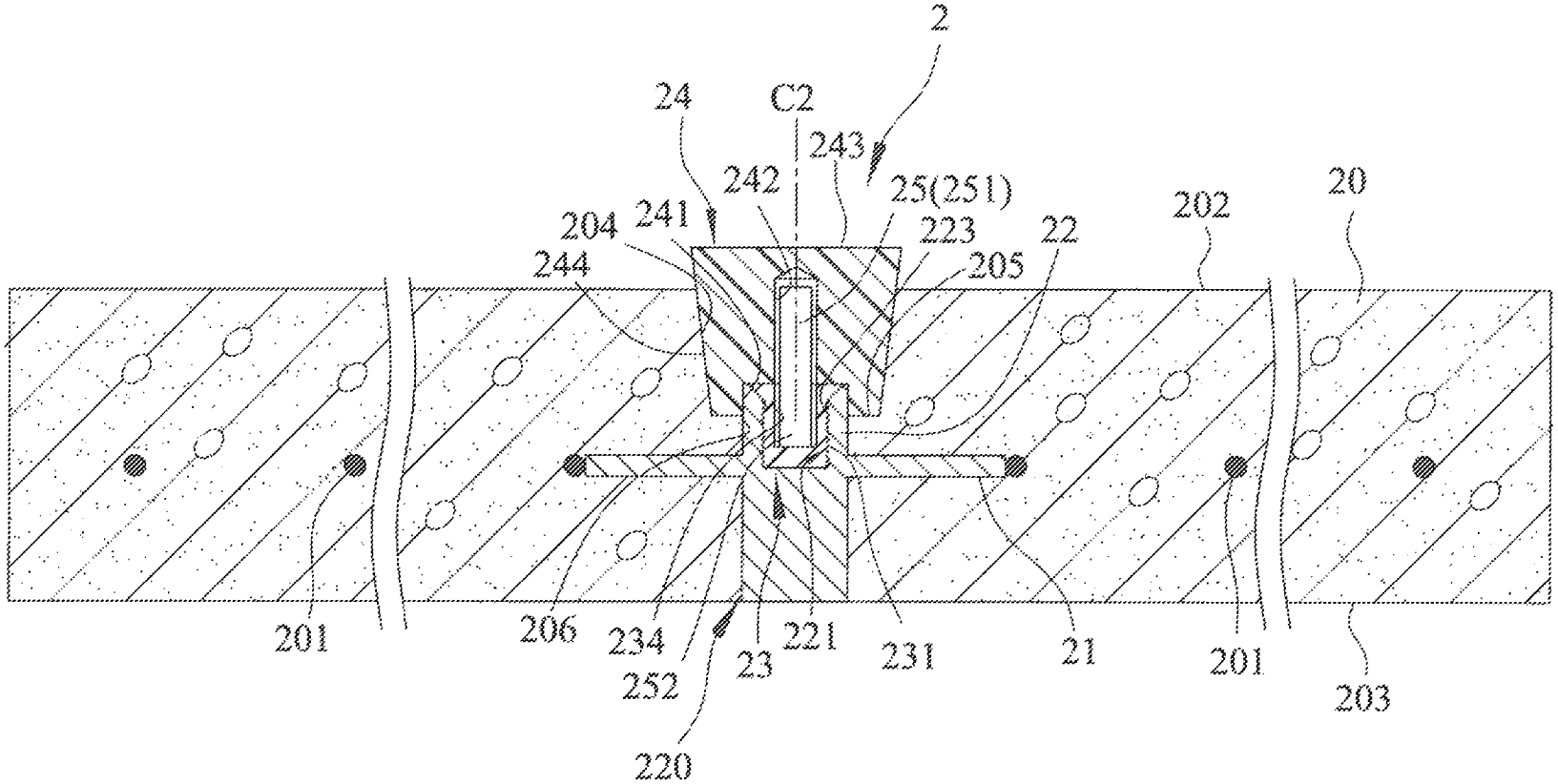
FIG. 5 is a cross-sectional view of the locatable slab assembly.

With reference to FIGS. 3 to 5, a locatable slab assembly 2 according to an embodiment of the disclosure is shown to include a slab body 20, a tubular member 22, a protective plug 24, and an electronic marker 25. The locatable slab assembly 2 is used for overlying a manhole cover 41 (see FIG. 8). The manhole cover 41 is located beneath a lowermost surface of a pavement 44 (see FIG. 9), and defines a center line (C1). The locatable slab assembly 2 is liftable by a lifting device 64 (see FIG. 14). The lifting device 64 has a gripped head 641 and a connected end segment 642 that is opposite to the gripped head 641 and that has an outer threaded surface 643, for example, with the dimension M32.

Referring back to FIGS. 5 and 8, it can be observed that the slab body 20 is configured to fully overlie the manhole cover 41 and defines a central line (C2) in line with the center line (C1). The slab body 20 has an upward surface 202, a downward surface 203, a cavity 204, and a bore 206. The cavity 204 extends downwardly from the upward surface 202 along the central line (C2) to terminate at a cavity bottom 205. The bore 206 extends downwardly from the cavity bottom 205 along the central line (C2).

In this embodiment, referring to FIGS. 4 and 5, it can be observed that the slab body 20 is of a steel reinforced concrete structure. The steel reinforced concrete structure of the slab body 20 is configured to simulate the contour of the manhole cover 41, and may have a predetermined dimension, e.g., 1400 mm×1400 mm×150 mm. In the steel reinforced concrete structure, a plurality of steel bars 201 are arranged into a grid pattern. As shown in FIG. 4, for example, eight of the steel bars 201 are arranged in a longitudinal direction, and eight of the steel bars 201 are arranged in a direction transverse to the longitudinal direction.

The tubular member 22 is fitted in the bore 206 (see FIG. 5), and has an inner threaded region 223 which surrounds the central line (C2), and which defines a lower chamber 221 extending to be in spatial communication with the cavity 204 along the central line (C2) (see FIGS. 3 and 5). The inner threaded region 223 has a dimension, for example, M32, and is configured to be brought into threaded engagement with the outer threaded surface 643 of the lifting device 64, so as to permit the locatable slab assembly 2 to be lifted by the lifting device 64 (see FIG. 14). In this embodiment, the tubular member 22 is made of a metal material.

The protective plug 24 has an enlarged head 243 and a plug body 244. The plug body 244 is configured to be inserted into the cavity 204 to permit the enlarged head 243 to be disposed outwardly of the slab body 20. The plug body 244 is formed with an upper chamber 242 extending to be in spatial communication with the lower chamber 221 along the central line (C2).

In this embodiment, the protective plug 24 is made of a plastic material, and is tapered from top to bottom. The protective plug 24 has, for example, a height of 80 mm, a maximum outer diameter of 100 mm, and a minimum outer diameter of 80 mm. The inner chamber 242 has an inner diameter of for example 20 mm, and a height of for example 50 mm. The enlarged head 243 has a height of for example 20 mm. The protective plug 24 has a recess 241 with a dimension, e.g., 50.8 mm×50.8 mm×15 mm. The recess 241 is in spatial communication with the upper chamber 242 along the central line (C2), and is configured to permit a top segment of the tubular member 22 to be received therein when the protective plug 24 is inserted into the cavity 204 (see FIG. 5).

The electronic marker 25 has an upper segment 251 and a lower segment 252. The upper segment 251 has a length of for example 46 mm, and is disposed in the upper chamber 242. The lower segment 252 has a length of for example 30 mm, and is disposed in the lower chamber 221. The electronic marker 25 is configured to permit a region 45 of the pavement 44 in alignment with the center line (C1) of the manhole cover 41 to be located (see FIG. 11). Because the lower segment 252 of the electronic marker 25 is disposed in the tubular member 22 made of metal, and because the upper segment 251 of the electronic marker 25 is disposed in the protective plug 24 made of plastic, the signal from the electronic marker 25 can be transmitted upwardly and is less likely to diverge so as to permit the region 45 of the pavement 44 in alignment with the center line (C1) of the manhole cover 41 to be precisely located.

The electronic marker 25 may be active or passive markers. In this embodiment, the electronic marker 25 is a radio-frequency identification (RFID) tag, and can generate a specific electromagnetic signal in response to an electromagnetic signal of a specific resonate frequency (for example, 13.56 MHz) from an REID reader. It should be noted that although the electronic marker 25 shown in figures are in the form of cylinder, the electronic marker 25 is actually in a corn-shape and is tapered from bottom to top for facilitating signal transmission.

In this embodiment, the locatable slab assembly 2 further includes a post member 220 and a flange member 21.

As shown in FIG. 5, the post member 220 extends downward from the tubular member 22 to be embedded in the slab body 20. The tubular member 22 and the post member 220 are integrally formed into a body with dimension, for example, 50 mm×50 mm×104 mm. The body including the tubular member 22 and the post member 220 is made of a metal material, and has an upper portion disposed upwardly of the flange member 21 by for example 34 mm, and a lower portion disposed downwardly of the flange member 21 by for example 60 mm. The lower chamber 221 may have a depth of for example 60 mm.

The flange member 21 extends radially from a juncture between the post member 220 and the tubular member 22 to be embedded in the slab body 20 for reinforcement of the tubular member 22. The flange member 21 may have a dimension of for example 200 mm×200 mm×10 mm.

In this embodiment, as shown in FIGS. 3 and 4, the flange member 21 has four through holes 212 at its corners, and is secured to innermost bars segments 207 of the steel bars 201 relative to the central line (C2) using four binding wires 26. Each of the through holes 212 may have a dimension of for example 12 mm. Two adjacent parallel ones of the steel bars, other than the innermost ones of the steel bars 201, are spaced apart from each other by a gap of for example 150 mm.

In this embodiment, as shown in FIG. 3, the locatable slab assembly 2 further includes a tubular bolt 23 which has a bolt head 233, an inner surface 234, and an outer bolt threaded surface 231, and which is detachably secured to the tubular member 22. The tubular bolt 23 may have a height of for example 40 mm. The bolt head 233 may have an outer diameter of for example 46 mm.

The inner surface 234 defines an inner space 230 which is configured to accommodate the lower segment 252 of the electronic marker 25 when the tubular bolt 23 is secured to the tubular member 22, and which may have a depth of for example 30 mm and an inner diameter of for example 20 mm.

The outer bolt threaded surface 231 is configured to be in threaded engagement with the inner threaded region 223 so as to permit the tubular bolt 23 to serve as a spacer between the tubular member 22 and the electronic marker 25. The outer bolt threaded surface 231 may have a dimension, for example, M32.

In this embodiment, the tubular bolt 23 is made of a metal material. Because the lower segment 252 of the electronic marker 25 is disposed in the tubular bolt 23 made of metal, the signal from the electronic marker 25 is less likely to diverge.

Figure 6:
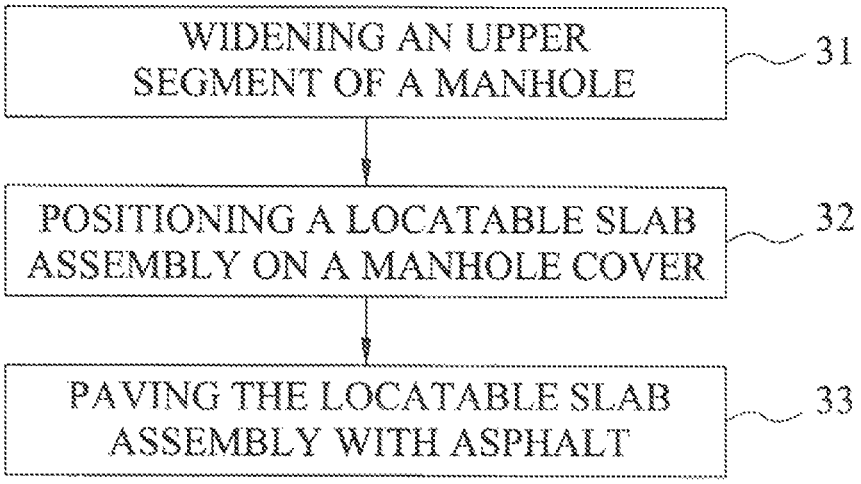
FIG. 6 is a flow chart showing a method for installing the locatable slab assembly.

As shown in FIG. 6, a method for installing the locatable slab assembly 2 includes steps 31 to 33.

Figure 7:
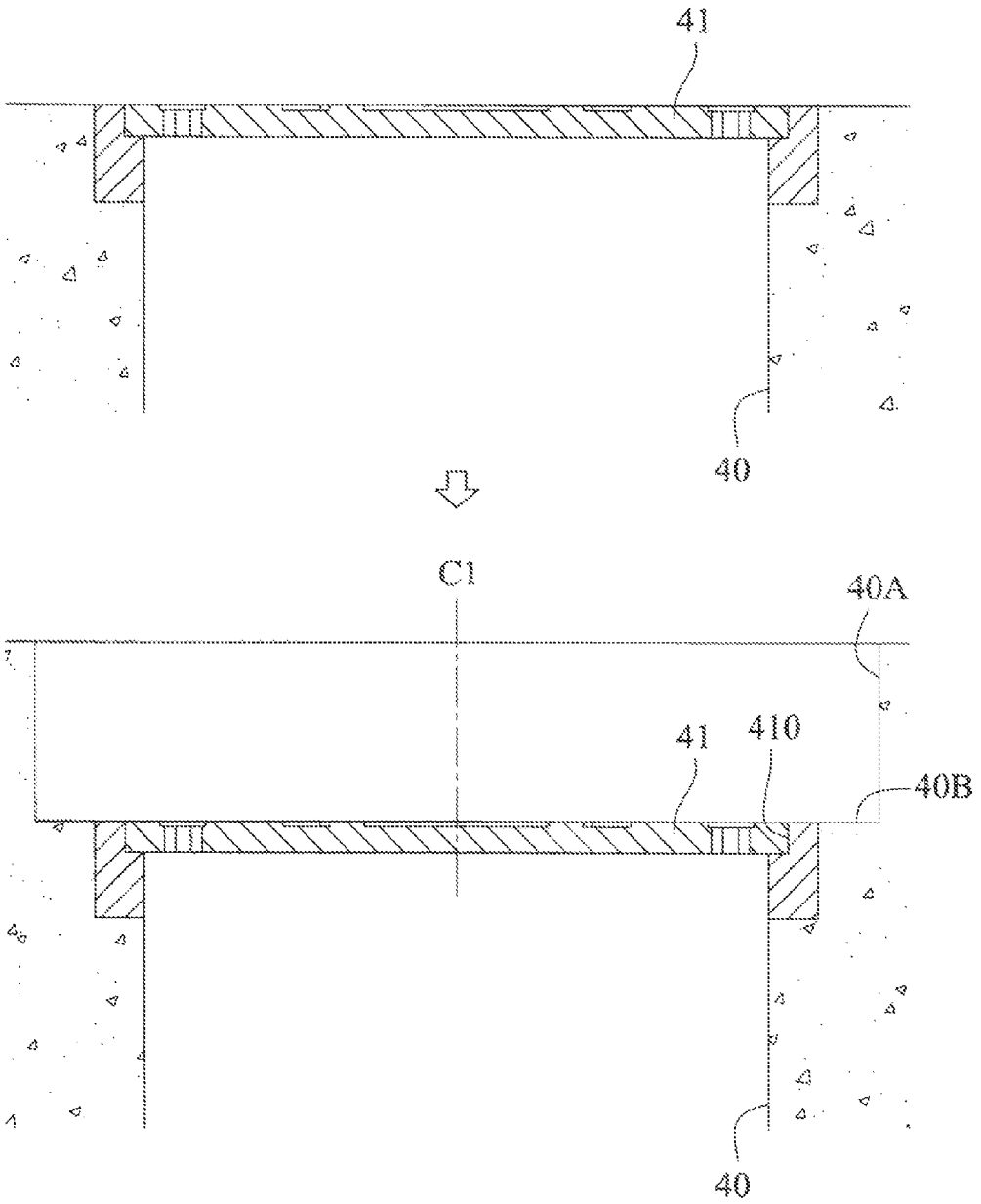
FIG. 7 is a schematic view illustrating a step of reconstructing a manhole opening to be located beneath the ground level.

In step 31, as shown in FIGS. 6 and 7, an upper segment 40A of the manhole 40, which is near the ground level, is widened so as to permit the manhole cover 41 to be located at a depth of for example 25 cm beneath the ground level. The widened upper segment 40A of the manhole 40 extends from the ground level to terminate at a base surface 40B with a manhole opening 410. The manhole cover 41 is disposed to cover the manhole opening 410. The base surface 40B may have an inner dimension of for example 1600 mm×1600 mm.

Figure 8:
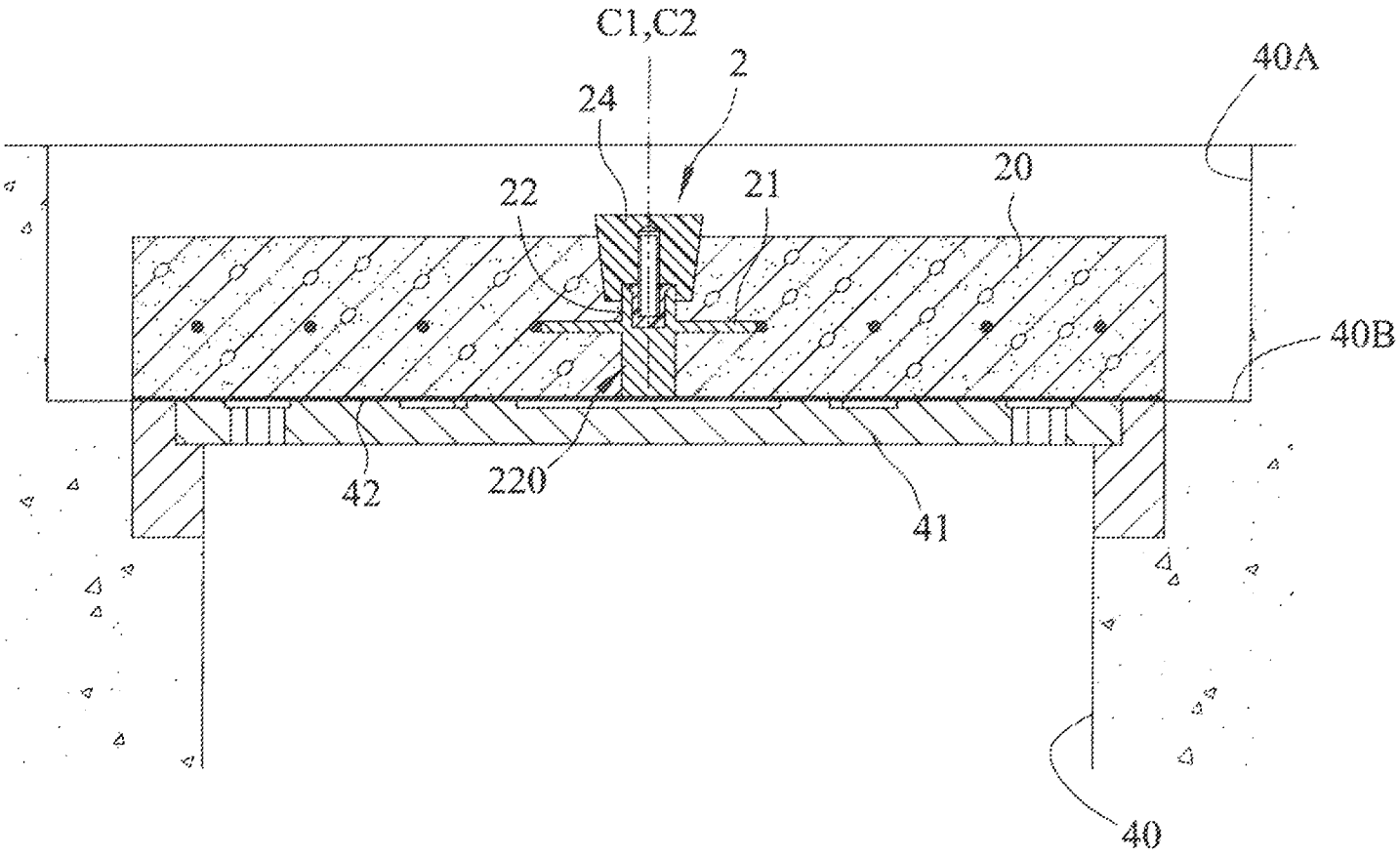
FIG. 8 is a schematic cross-sectional view illustrating the locatable slab assembly disposed to overlie a manhole cover.

In step 32, as shown in FIGS. 6 and 8, the base surface 40B surrounding the manhole cover 41 is solidified. A soft foam layer 42, which may have a thickness of for example 2 mm, has a surface area substantially the same as that of the manhole cover 41, and is disposed to fully overlie the manhole cover 41 to serve as a spacer between the manhole cover 41 and the locatable slab assembly 2. Then, the locatable slab assembly 2 is disposed on the soft foam layer 42 such that the central line (C2) of the locatable slab assembly 2 is in line with the center line (C1) of the manhole cover 41. The provision of the soft foam layer 42 can prevent the manhole cover 41 from being damaged by the locatable slab assembly 2.

Figure 9:
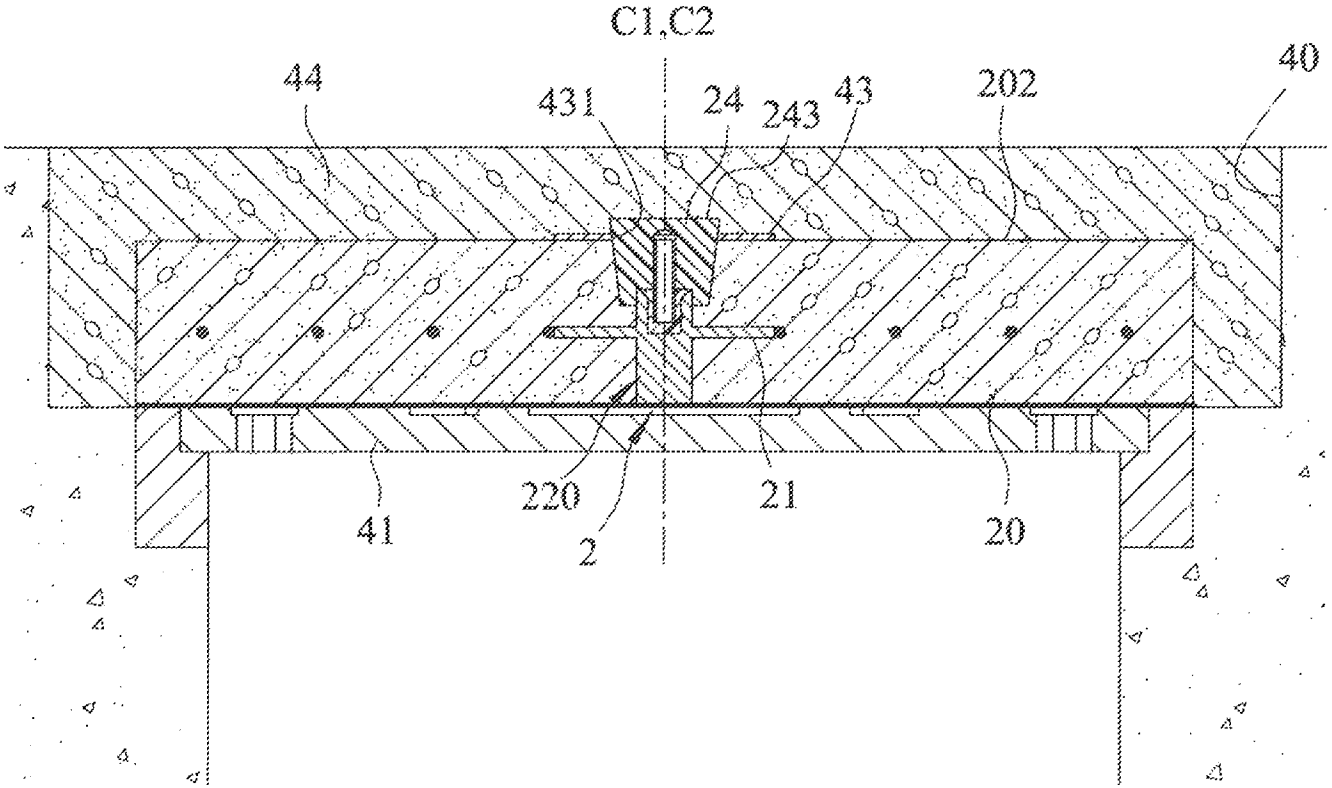
FIG. 9 is a schematic cross-sectional view illustrating that the locatable slab assembly and the manhole cover are located beneath a pavement.

In step 33, as shown in FIGS. 6 and 9, a spacer slice 43 with an opening 431 is sleeved on the enlarged head 243 of the protective plug 24 to cover on the upward surface 202 of the slab body 20. The spacer slice 43 is made of a flexible material such as an acrylic elastic material, and has a surface area substantially the same as that of the flange member 21 so as to be disposed in alignment with the flange member 21 along the central line (C2). The opening 431 has a diameter of for example 97 mm. Because the spacer slice 43 is flexible and has the opening 431 slightly smaller than the maximum diameter of the protective plug 24, the spacer slice 43 can be stretched to be fittingly sleeved on the protective plug 24. Thereafter, the upward surface 202 of the slab body 20 uncovered by the spacer slice 43 is coated with asphalt oil, and then the base surface 40B and the locatable slab assembly 2 are paved with asphalt to form the pavement 44 such that an uppermost surface of the pavement 44 is flush with the ground level. A distance between the uppermost surface of the pavement 44 and the upward surface 202 of the slab body 20 is for example 100 mm.

Figure 10:
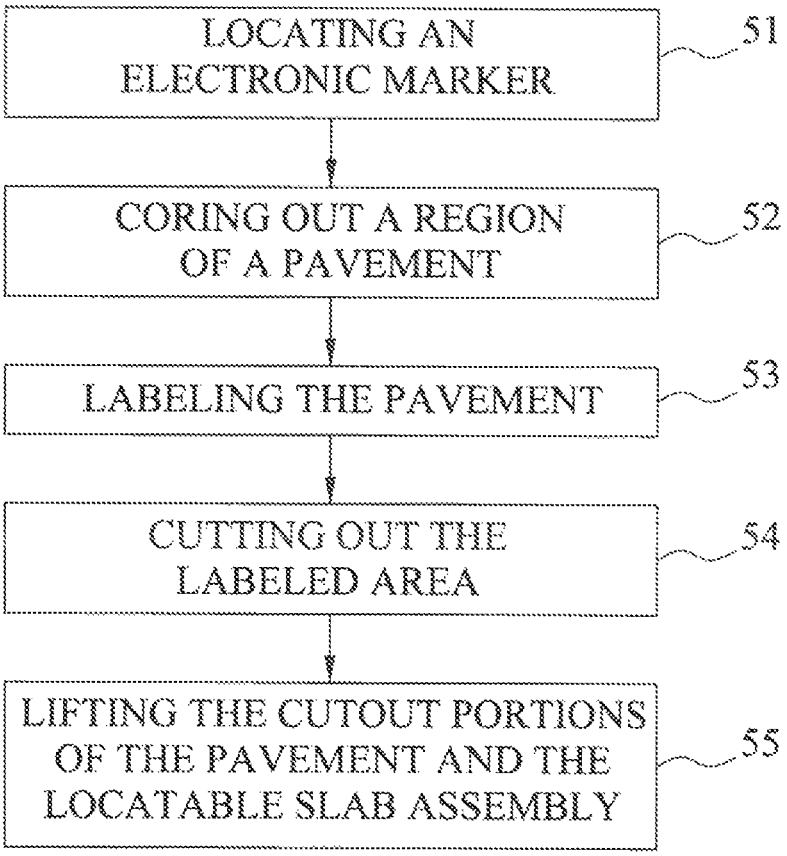
FIG. 10 is a flow chart showing a method for assessing to the manhole cover using the locatable slab assembly.

As shown in FIG. 10, a method for assessing to the manhole cover 41 using the locatable slab assembly 2 includes steps 51 to 56.

Figure 11:
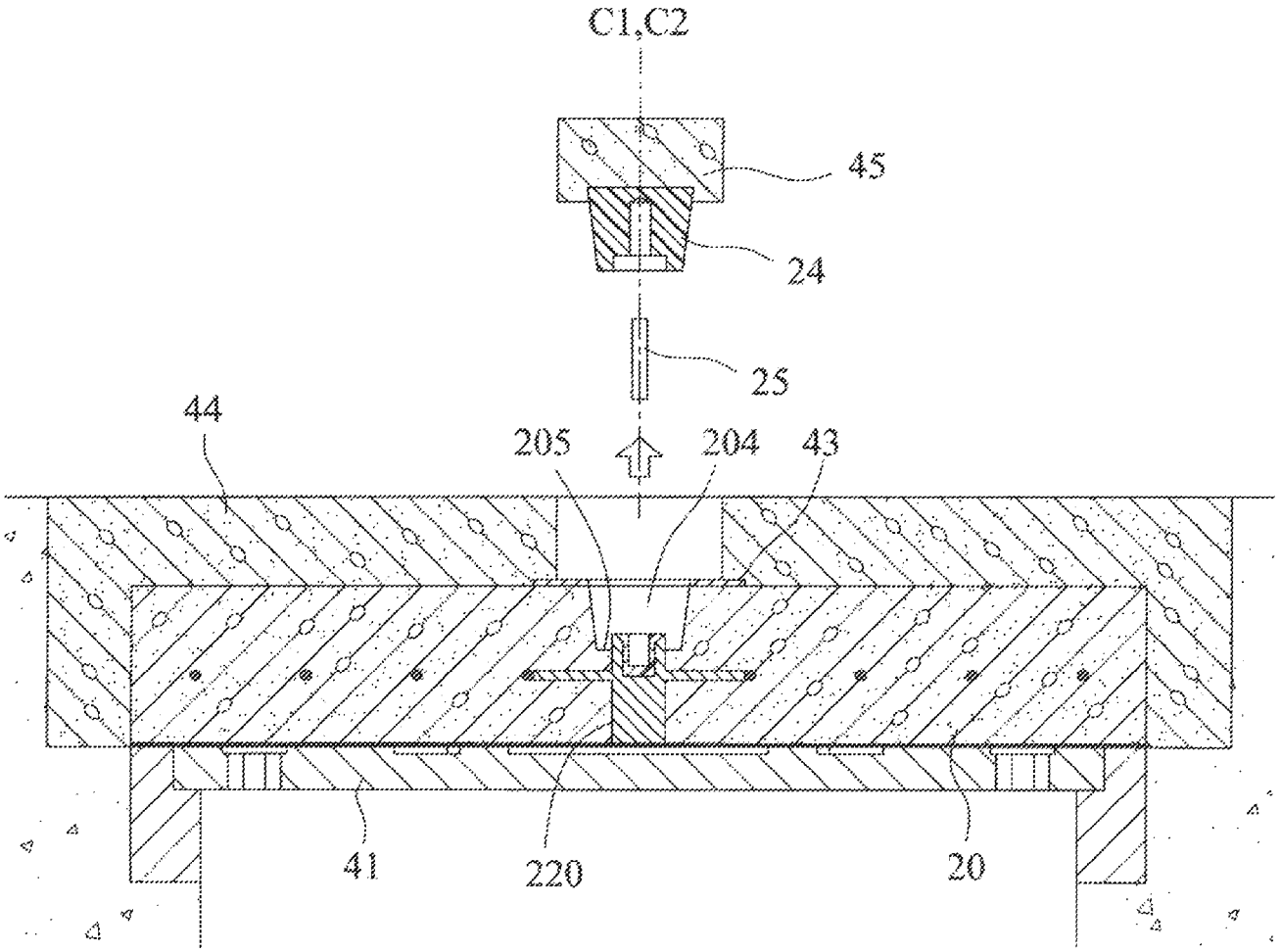
FIG. 11 is a schematic cross-sectional view illustrating a region of the pavement to be located and removed.

In step 51, an REID reader (not shown) is used for locating the electronic marker 25 so as to locate the central line (C2) of the locatable slab assembly 2 (see FIG. 9) to thereby determine the region 45 of the pavement 44 which may have a diameter of for example 150 mm and a height of for example 100 mm (see FIG. 11).

In step 52, as shown in FIG. 11, the region 45 is cored out from the pavement 44 using a conventional tool such as a pavement core drilling machine (not shown). Because the bonding force between the protective plug 24 and the asphalt (the pavement 44) is stronger than that between the protective plug 24 and the concrete (the slab body 20), the protective plug 24 will be removed from the cavity 204 of the slab body 20 when the region 45 is cored out from the pavement 44. Thereafter, the electronic marker 25 is also removed.

Figure 12:
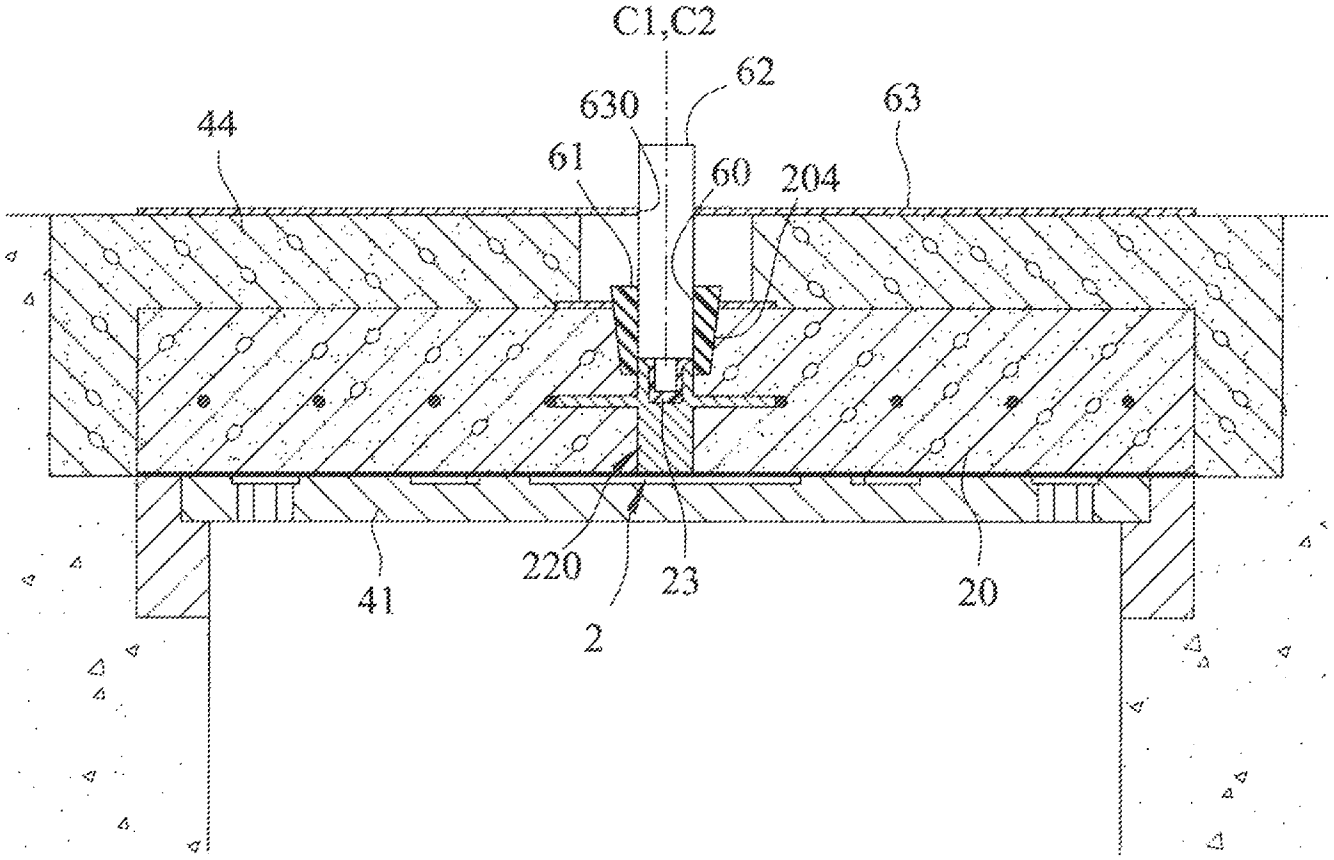
FIG. 12 is a schematic cross-sectional view illustrating a periphery of the manhole cover to be determined using a template.

In step 53, as shown in FIG. 12, a jig 61 is fitted into the cavity 204 of the slab body 20 to permit a through hole 60 of the jig 61 to extend along the central axis (C2). Next, a lower segment of an index post 62 is inserted into the through hole 60 to permit an upper segment of the index post 62 to extend along the central axis (C2) out of the uppermost surface of the pavement 44. Then, a template 63 with a through bore 630 is fittingly sleeved on the upper segment of the index post 62 to overlie on the uppermost surface of the pavement 44. The template 63 may have a plurality of cutouts (not shown) for labeling the pavement 44 corresponding to the periphery of the locatable slab assembly 2. The pavement 44 can be labeled by applying paint to the pavement 44 through the cutouts of the template 63 to form a mark. The labeled area may have a dimension of for example 1200 mm×1200 mm or 1300 mm×1300 mm.

Figure 13:
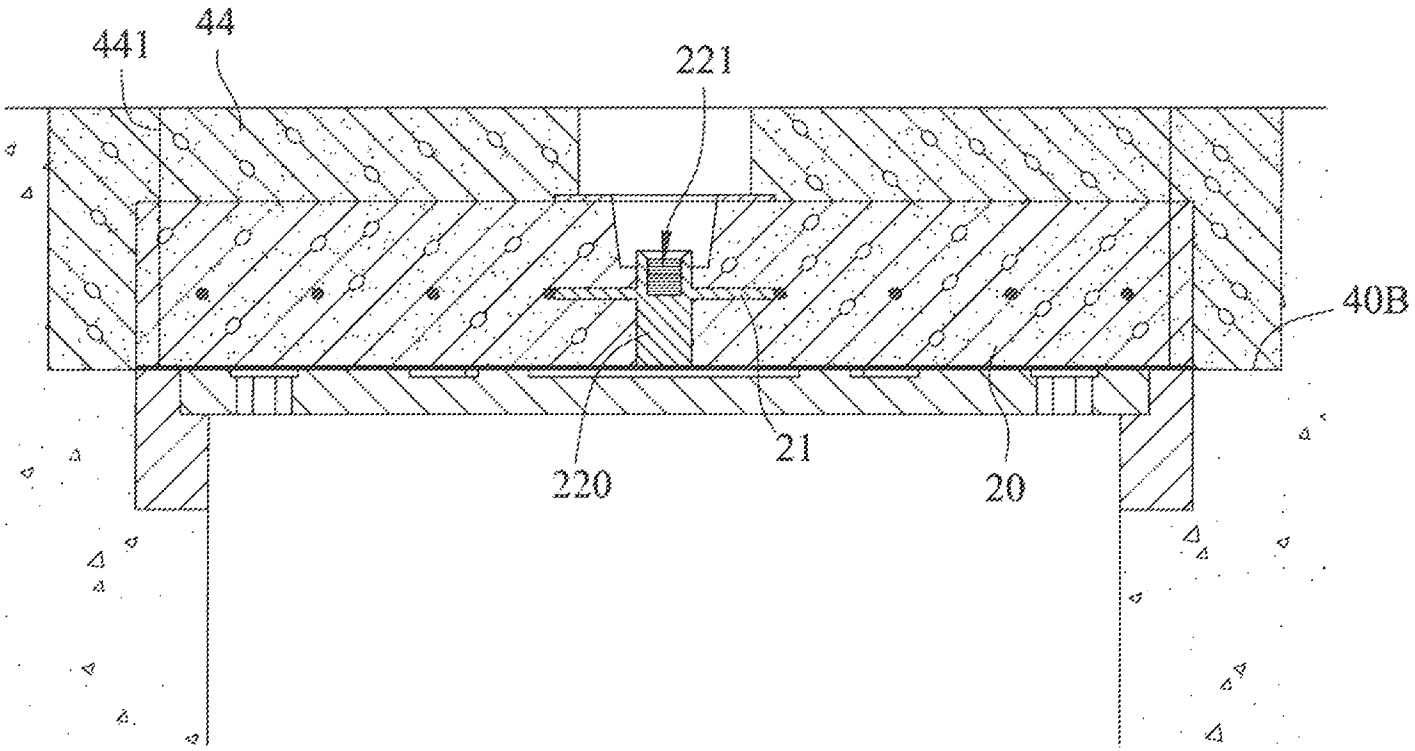
FIG. 13 is a schematic cross-sectional view illustrating that the pavement and the locatable slab assembly are cut along a cutting line.

In step 54, the template 63, the index post 62, the jig 61, and the tubular bolt 23 are removed, and the pavement 44 and the locatable slab assembly 2 above the manhole cover 41 are cut along the mark. As shown in FIG. 13, a cutting line 441 extends from the pavement 44 through the locatable slab assembly 2 to terminate at the base surface 40B.

Figure 14:
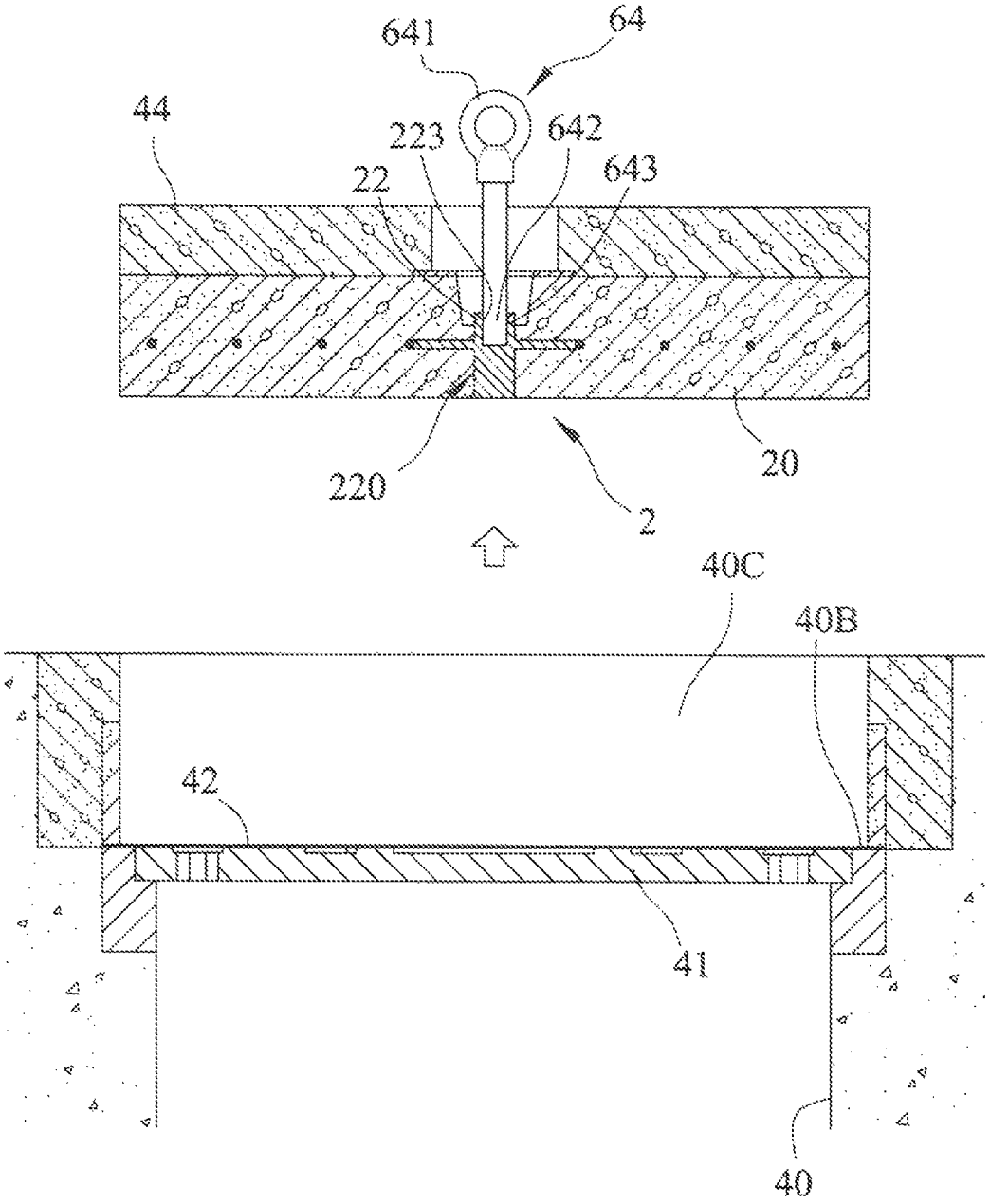
FIG. 14 is a schematic cross-sectional view illustrating that the pavement and the locatable slab assembly are lifted using a lifting device to form an accessing opening for accessing to the manhole cover.

In step 55, as shown in FIG. 14, the outer threaded surface 643 of the lifting device 64 is brought into threaded engagement with the inner threaded region 223 of the tubular member 22 so as to be secured to the locatable slab assembly 2. Then, the gripped head 641 is gripped by a hoist (not shown), the cutout portions of the pavement 44 and the locatable slab assembly 2 are lifted by the hoist through the lifting device 64 to form an accessing opening 40C. After the soft foam layer 42 and the manhole cover 41 are removed, an operator can access to the manhole 40.

Figure 15:
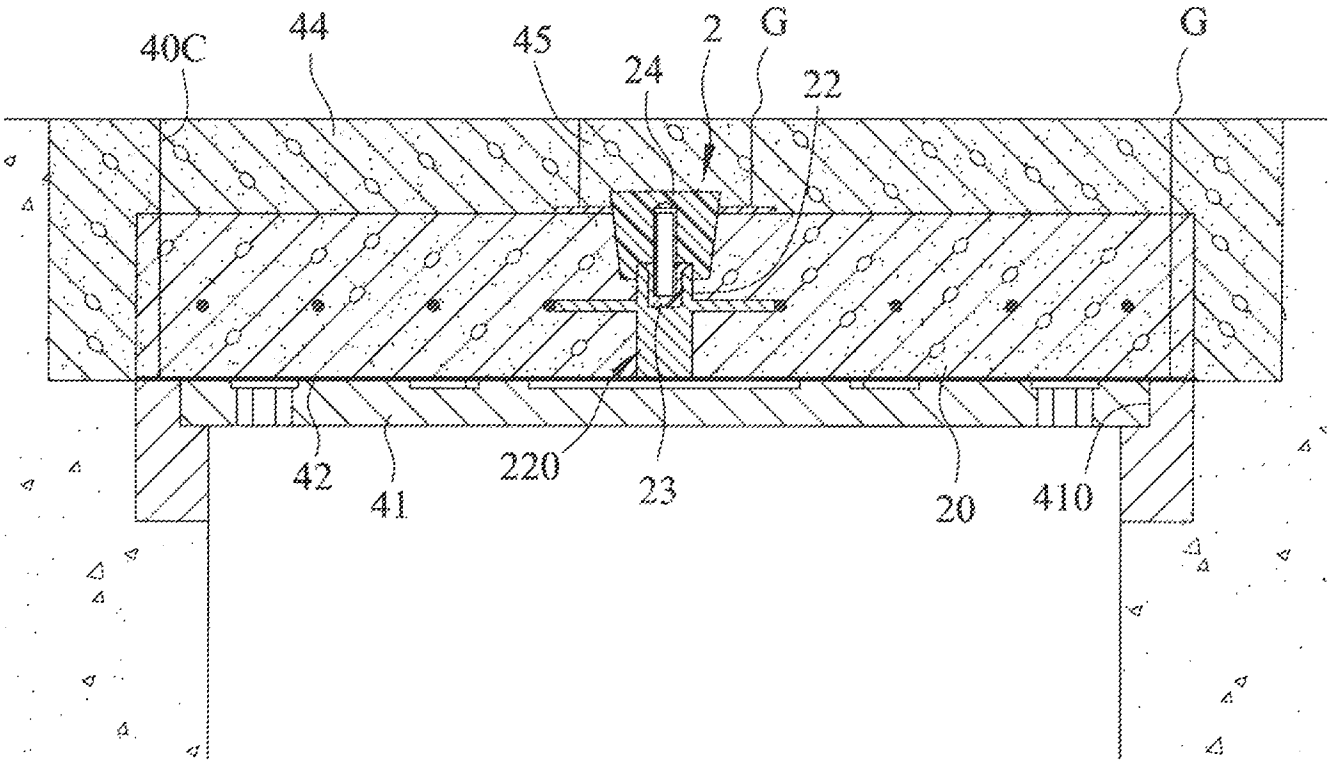
FIG. 15 is a schematic cross-sectional view illustrating that the cutout portions of the pavement and the locatable slab assembly are refilled in the accessing opening.

After the operator has finished his work, the manhole cover 41 is disposed to cover the manhole opening 410, the soft foam layer 42 is disposed to overlie the manhole cover 41, the cutout portions of the pavement 44 and the locatable slab assembly 2 can be refilled in the accessing opening 40C, and the tubular bolt 23, the electronic marker 25, the region 45 of the pavement 44 together with the protective plug 24 can be moved to their original positions, as shown in FIG. 15. Gaps (G) formed on the pavement 44 can be filled with an adhesive (MS-R301, Retek International Equipment Co., Ltd., Taiwan). Because the gaps (G) can be observed from the ground level, it is more convenient to access to the manhole 40 the next time.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A locatable slab assembly for overlying a manhole cover which is located beneath a lowermost surface of a pavement, and which defines a center line, said locatable slab assembly being liftable by a lifting device which has a gripped head and a connected end segment that is opposite to the gripped head and that has an outer threaded surface, said locatable slab assembly comprising:

a slab body configured to fully overlie the manhole cover, and defining a central line in line with the center line, said slab body having an upward surface and a downward surface, a cavity extending downwardly from said upward surface along the central line to terminate at a cavity bottom, and a bore extending downwardly from said cavity bottom along the central line;

a tubular member fitted in said bore, and having an inner threaded region which surrounds the central line, and which defines a lower chamber extending to be in spatial communication with said cavity along the central line, said inner threaded region being configured to be brought into threaded engagement with the outer threaded surface, so as to permit said locatable slab assembly to be lifted by the lifting device;

a protective plug having an enlarged head and a plug body which is configured to be inserted into said cavity to permit said enlarged head to be disposed outwardly of said slab body, said plug body being formed with an upper chamber extending to be in spatial communication with said lower chamber along the central line; and an electronic marker having an upper segment disposed in said upper chamber and a lower segment disposed in said lower chamber, said electronic marker being configured to permit a region of the pavement in alignment with the center line of the manhole cover to be located.

2. The locatable slab assembly according to claim 1, further comprising:

a post member extending downward from said tubular member to be embedded in said slab body; and a flange member extending radially from a juncture between said post member and said tubular member to be embedded in said slab body for reinforcement of said tubular member.

3. The locatable slab assembly according to claim 2, wherein said slab body is of a steel reinforced concrete structure in which a plurality of steel bars are arranged into a grid pattern, said flange member being secured to innermost bars segments of said steel bars relative to the central line.

4. The locatable slab assembly according to claim 1, further comprising a tubular bolt which has an inner surface defining an inner space which is configured to accommodate said lower segment of said electronic marker, and an outer bolt threaded surface configured to be in threaded engagement with said inner threaded region so as to permit said tubular bolt to serve as a spacer between said tubular member and said electronic marker.

5. The locatable slab assembly according to claim 1, wherein said slab body is configured to simulate the contour of the manhole cover.

6. The locatable slab assembly according to claim 3, wherein said tubular member and said tubular bolt are made of a metal material, and said protective plug is made of a plastic material.

7. The locatable slab assembly according to claim 1, wherein said protective plug is tapered from top to bottom.

* * * * *